US006854998B2

(12) United States Patent
Yuan

(10) Patent No.: US 6,854,998 B2
(45) Date of Patent: Feb. 15, 2005

(54) WIRING BLOCK AND COVER SHELL ARRANGEMENT FOR ELECTRIC CONNECTOR

(75) Inventor: Thomas Yuan, Taipei (TW)

(73) Assignee: Lorom Industrial Co., Ltd., Taipei (TW)

( * ) Notice: Subject to any disclaimer, the term of this patent is extended or adjusted under 35 U.S.C. 154(b) by 0 days.

(21) Appl. No.: 10/601,520

(22) Filed: Jun. 24, 2003

(65) Prior Publication Data

US 2004/0127088 A1 Jul. 1, 2004

(30) Foreign Application Priority Data

Dec. 25, 2002 (TW) ..... 91221062 U

(51) Int. Cl.[7] ..... H01R 11/20
(52) U.S. Cl. ..... 439/404
(58) Field of Search ..... 439/404, 406, 439/407

(56) References Cited

U.S. PATENT DOCUMENTS 3,980,380 A * 9/1976 Cieniawa et al. ..... 439/404
4,960,388 A * 10/1990 Frantz et al. ..... 439/404
4,960,389 A * 10/1990 Frantz et al. ..... 439/404
5,464,352 A * 11/1995 Van Emmerick ..... 439/404
5,662,492 A * 9/1997 Weiss ..... 439/404
6,113,420 A * 9/2000 Harting et al. ..... 439/459
6,120,316 A * 9/2000 Allgaier et al. ..... 439/404
6,544,067 B2 * 4/2003 Hagmann ..... 439/404
6,551,144 B2 * 4/2003 Wellmann et al. ..... 439/689

* cited by examiner

*Primary Examiner*—Phuong Dinh
(74) *Attorney, Agent, or Firm*—Bacon & Thomas

(57) ABSTRACT

A wiring block and cover shell arrangement for electric connector in which the wiring block has two smoothly arched bearing walls perpendicularly extended from the front surface of the base thereof and equally spaced from the center of the base at two sides, two sets of parallel crevices symmetrically formed in the bearing walls and respectively cut through the height of the bearing walls to the base, and two sets of slots respectively cut through the height of the bearing walls and front and back sides of the base across the crevices for accommodating a respective wire clamp to fasten the insulated wires of the twisted pairs of a cable, maintaining an equal delay skew at each twisted pair of the cable.

1 Claim, 4 Drawing Sheets

WIRING BLOCK AND COVER SHELL ARRANGEMENT FOR ELECTRIC CONNECTOR

BACKGROUND OF THE INVENTION

1. Field of the Invention

The present invention relates to electric connectors and, more specifically, to a wiring block and cover shell arrangement for use in an electric connector, which keeps the twisted pairs respectively connected to the respective wire clamps at the same distance, so as to have same delay skew, ensuring the unity of signal and, preventing the occurrence of error codes.

2. Description of the Related Art

Transmission of data between electronic apparatus can be achieved by any of a variety of interfaces including electric pulse, cable carrying pulse, and connector connecting computer and apparatus. FIG. 1 illustrates an electric connector for this purpose. This structure of electric connector is comprised of a jack 6 and a plug 7 matching the jack 6. The jack is normally installed in a control panel, printed circuit board, or a wall, having a wiring block 61 to which a cable 5 is connected. The plug 7 has one end connected to a cable 8 and the other end connectable to the jack 6. The subject of the present invention pertains to the wiring block 61.

Referring to FIG. 1 again, the cable 5 is comprised of four twisted pairs. Each twisted pair includes two insulated wires 51 twisted together. Each insulated wire 51 comprises a wire conductor (copper wire) and an insulator covering the wire conductor. During installation, the insulators of the insulated wires 51 of the cable 5 are stripped off at about 5 cm (about 2 inches) from the end, and then the insulated wires 51 are respectively engaged into respective wire clamps 4 in the wiring block 61.

Because a high-speed network transmits signal through the four twisted pairs at the same time, a great delay skew (propagation delay time difference) among the twisted pairs affects the unity of signal and, may cause the occurrence of error codes. Therefore, it is necessary to calculate the time difference between the transmission in the twisted pair having the longest propagation delay and the transmission in the other three twisted pairs. Because the pitch of each twisted pair is different, the propagation delay (the time used in each twisted pair from start of signal transmission to receipt of signal at the other end) in every twisted pair is different. Therefore, the propagation delay skew between twisted pairs was never taken into account. However, in next generation wire materials, metal shield is used, and the twisted pairs have the same pitch, and therefore the propagation delay skew becomes important. Because every twisted pair transmits differential signal, the propagation delay skew among the wires of each twisted pair is important.

As illustrated in FIG. 2, because the wire clamps 4 are arranged into two parallel rows, the four twisted pairs cannot be respectively connected to the wire clamps 4 at an equal distance. Therefore, the time used in each twisted pair from start of signal transmission to receipt of signal at the other end is different, i.e., the propagation delay in each twisted pair is different. Excessive delay skew affects the unity of signal and may produce error codes.

Further, because the insulated wires 51 and the wire clamps 4 are intersected and the wire clamps 5 cut through the insulators of the insulated wires 51, the insulated wires 51 do not slip in longitudinal direction. However, the clamping force of the wire clamps 4 cannot effectively prohibit displacement of the insulated wires 51 in the axial direction of the respective wire clamps 4, i.e., the connection between the cable 5 and the wiring block 61 is positive.

SUMMARY OF THE INVENTION

The invention has been accomplished under the circumstances in view.

It is one object of the present invention to provide a wiring block and cover shell arrangement for electric connector, which eliminates the drawbacks of the aforesaid prior art design.

It is another object of the present invention to provide a wiring block and cover shell arrangement for electric connector, which keeps the twisted pairs respectively connected to the respective wire clamps at an equal distance, so as to have same delay skew, ensuring the unity of signal and, preventing the occurrence of error codes.

It is another object of the present invention to provide a wiring block and cover shell arrangement for electric connector, which secure the insulated wires of the twisted pairs to the respectively wire clamps positively, preventing displacement of the insulated wires in the axial direction of the respective wire clamps.

According to one aspect of the present invention, the wiring block and cover shell arrangement comprises a wiring block. The wiring block comprises a flat base, two protruding engagement portions located on two opposite lateral sides of the base for mounting, two smoothly arched bearing walls perpendicularly extended from a front surface of the base and equally spaced from the center of the base at two sides, two sets of parallel crevices symmetrically formed in the smoothly arched bearing walls and respectively cut through the height of the smoothly arched bearing walls to a front surface of the base, and two sets of slots respectively cut through the height of the smoothly arched bearing walls and front and back sides of the base across the crevices for accommodating a respective wire clamp to fasten the insulated wires of the twisted pairs of a cable.

According to another aspect of the present invention, the wiring block and cover shell arrangement further comprises a cover shell covered on the wiring block to hold down the insulated wires of the twisted pair of the cable being connected to the wiring block, the cover shell comprising a center through hole, through which the cable connected to the wiring block passes, and a plurality of plugs arranged into two arched rows and equally spaced from the center of the center through hole at two sides and respectively pressed into the slots of the wiring block to hold down the insulated wires of the cable in the wire clamps been installed in the slots of the wiring block.

DETAILED DESCRIPTION OF THE PREFERRED EMBODIMENT

Figure 1:
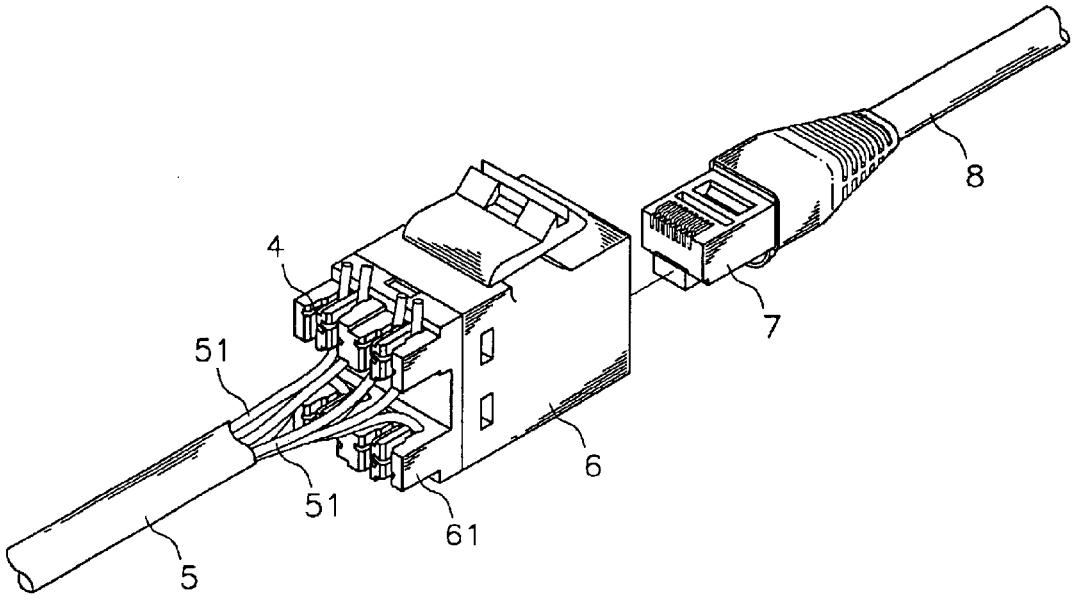
FIG. 1 (Prior Art)
FIG. 1 is an exploded view of an electric connector according to the prior art.
Figure 2:
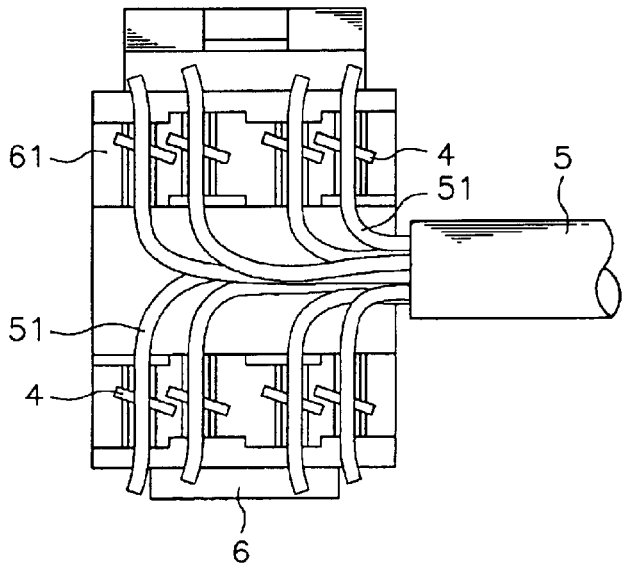
FIG. 2 (Prior Art)
FIG. 2 is a plain view in an enlarged scale of a part of FIG. 1, showing the insulated wires of the twisted pairs respectively connected to the wire clamps of the wiring block.
Figure 3:
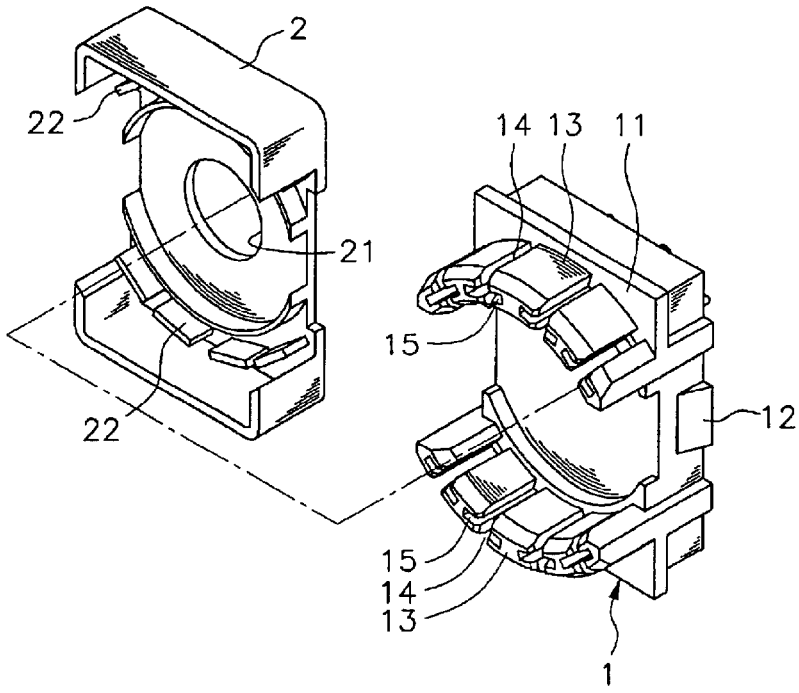
FIG. 3 is an exploded view of a wiring block and cover shell arrangement according to the present invention.
Figure 4:
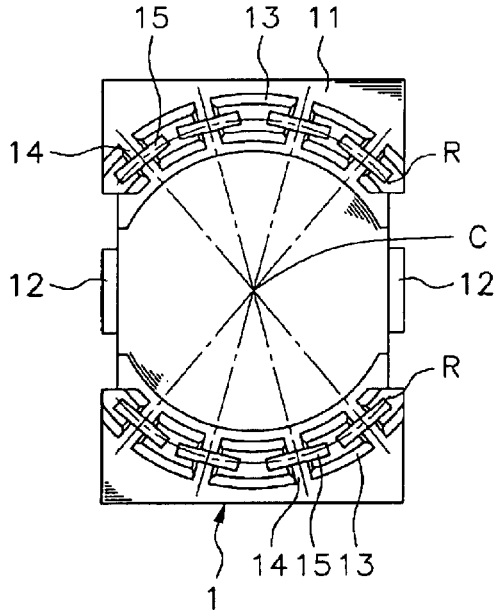
FIG. 4 is a top view of the wiring block according to the present invention.
Figure 5:
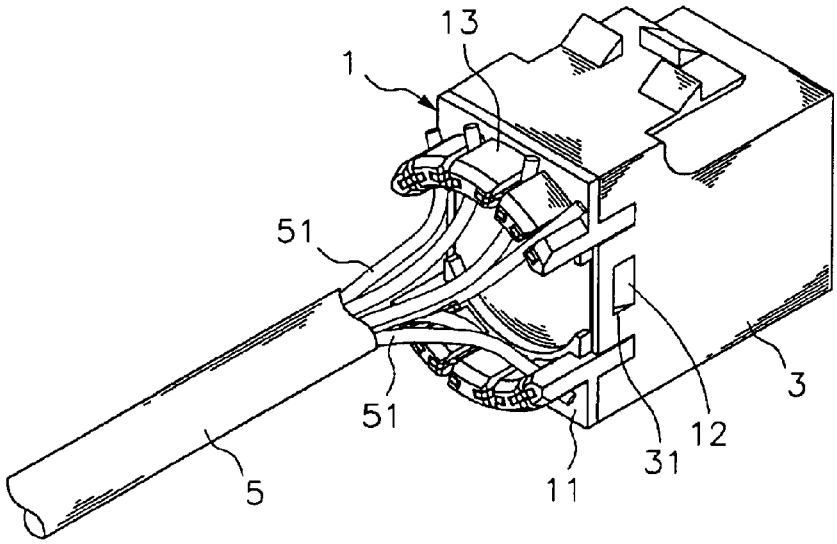
FIG. 5 is an installed view of the present invention, showing the wiring block connected with a cable and mounted in an electrically insulative housing.

Referring to FIGS. 3~5, a wiring block 1 is shown comprises a base 11 fitting an electrically insulative housing 3. The base 11 can be made having any of a variety of shapes subject to the housing 3. According to this embodiment, the base 11 has a rectangular shape. The wiring block 1 further comprises two protruding engagement portions 12 located on two opposite lateral sides of the base 11 and respectively engaged into respective engagement holes 31 of the housing 3 to secure the wiring block 1 to the housing 3 firmly (see FIG. 5), two smoothly arched bearing walls 13 perpendicularly extended from the front surface of the base 11 and equally spaced from the center C of the base 11 at two sides, two sets of parallel crevices 14 symmetrically formed in the smoothly arched bearing walls 13 and respectively cut through the height of the smoothly arched bearing walls 13 to the front surface of the base 11, and two sets of slots 15 respectively cut through the height of the smoothly arched bearing walls 13 and the thickness of the base 11 across the crevices 14. The slots 15 are equally spaced from the center C of the base 11, i.e., the slots 15 in the same smoothly arched bearing wall 13 are respectively disposed in the same circular arch R of which the center is the center C (see FIGS. 5 and 6). The crevices 14 are provided for the passing of the insulated wires 51 of the cable, referenced by 5. The slots 15 are adapted to accommodate wire clamps 4 respectively (see FIG. 7). The wire clamps 4 are stamped from a copper plate or any of a variety of suitable electrically conducting plate members, and respectively plugged into the slots 15 from the back side of the base 11 by force. When the insulated wires 51 of the cable 5 forced into the wire clamps 4 in the slots 15, the wire clamps 4 pierce the insulators of the insulated wires 51 and contact the conductors of the insulated wires 51 respectively. The wire clamps 4 are obtained from conventional techniques and not within the scope of the claims of the present invention, no further detailed description in this regard is necessary.

Figure 6:
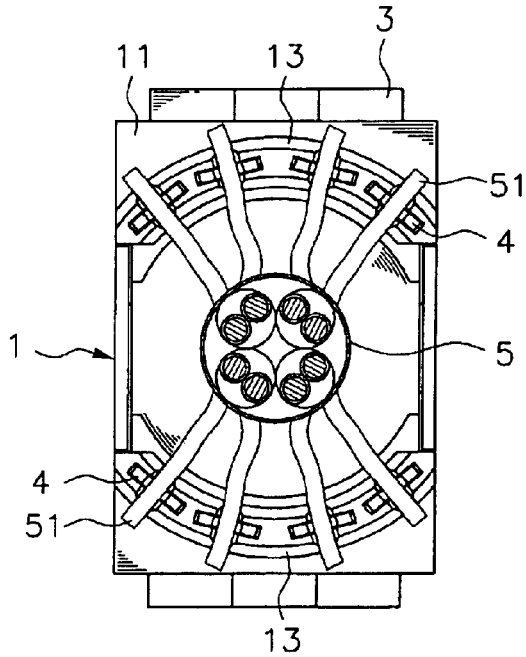
FIG. 6 is a plain view of FIG. 5.
Figure 7:
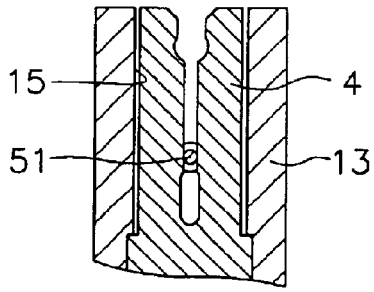
FIG. 7 is a sectional view of a part of the wiring block according to the present invention.

As illustrated in FIG. 4, because the distance between the center C of the wiring block 1 and each slot 15 is equal, the insulated wires 51 of the cable 5 can be respectively connected to the wire clamps 4 at an equal distance (see FIG. 6). Therefore, the propagation delay at every twisted pair is equal, i.e., same delay skew, ensuring the unity of signal and, preventing the occurrence of error codes.

Figure 8:
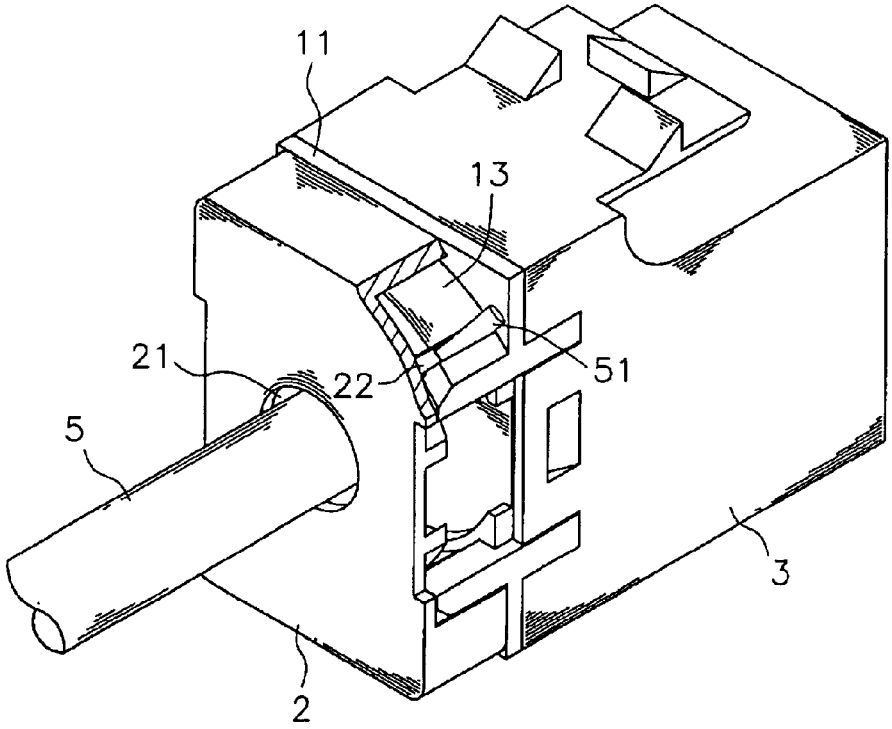
FIG. 8 is a cutaway of an electric connector constructed according to the present invention.

In order to prevent escape of the insulated wires 51 from the wire clamps 4, a cover shell 2 is used and covered on the wiring block 1 to hold down the insulated wires 51 (see FIGS. 3 and 8). The cover shell 2 comprises a center through hole 21 for the passing of the cable 5, and a plurality of plugs 22 arranged into two arched rows and equally spaced from the center of the center through hole 21 at two sides and respectively pressed into the slots 15 to hold down the insulated wires 51 in the wire clamps 4.

A prototype of wiring block and cover shell arrangement has been constructed with the features of FIGS. 3~8. The wiring block and cover shell arrangement functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A wiring block and cover shell arrangement, comprising:

said wiring block comprising a flat base, said flat base having a center, two protruding engagement portions located on two opposite lateral sides of said flat base for mounting, two smoothly arched bearing walls perpendicularly extended from a front surface of said flat base and equally spaced from the center of said flat base at two sides, two sets of parallel crevices symmetrically formed in said two smoothly arched bearing walls and respectively cut through the height of said two smoothly arched bearing walls and front and back sides of said flat base across said crevices for accommodating a respective wire clamp to fasten insulated wires of twisted pairs of a cable; and said cover shell covered on said wiring block to hold down the insulated wires of the twisted pair of the cable being connected to said wiring block, said cover shell comprising a center through hole, through which the cable connected to said wiring block passes, and a plurality of plugs arranged into two arched rows and equally spaced from the center of said center through hole at two sides and respectively pressed into said slots of said wiring block to hold down the insulated wires of the cable in the wire clamps being installed in slots of said wiring block.

* * * * *